US005440322A

United States Patent [19]

Prince et al.

[11] Patent Number: 5,440,322

[45] Date of Patent: Aug. 8, 1995

[54] PASSIVE MATRIX DISPLAY HAVING REDUCED IMAGE-DEGRADING CROSSTALK EFFECTS

[75] Inventors: Dennis W. Prince, Banks; Benjamin R. Clifton, Oregon City, both of Oreg.

[73] Assignee: In Focus Systems, Inc., Wilsonville, Oreg.

[21] Appl. No.: 152,424

[22] Filed: Nov. 12, 1993

[51] Int. Cl.[6] ..... G09G 3/04

[52] U.S. Cl. ..... 345/58; 345/55

[58] Field of Search ..... 345/58, 55, 103, 104

[56] References Cited

U.S. PATENT DOCUMENTS

| | | | |
|---|---|---|---|
| 4,026,072 | 12/1986 | Clerc et al. | 345/55 |
| 4,816,816 | 3/1989 | Usui | 345/103 |
| 4,839,634 | 6/1989 | More et al. | 345/104 |
| 4,845,482 | 7/1989 | Howard et al. | 345/58 |
| 5,298,914 | 3/1994 | Yamazaki | 345/103 |
| 5,301,047 | 4/1994 | Hoshino et al. | 359/55 |

FOREIGN PATENT DOCUMENTS

| | | | |
|---|---|---|---|
| 0374845 | 6/1990 | European Pat. Off. . | |
| 0434033 | 6/1991 | European Pat. Off. . | |
| 0455204 | 11/1991 | European Pat. Off. . | |
| 0466506A2 | 1/1992 | European Pat. Off. | G09G 3/36 |
| 0542307 | 5/1993 | European Pat. Off. . | |
| 645473 | 9/1984 | Switzerland . | |

OTHER PUBLICATIONS

Y. Kaneko et al., "Crosstalk-Free Driving Methods for STN-LCDs," Proceedings of the SID, vol. 31/4 1990, pp. 333-336.

H. Hirai et al., "A New Driving Method for Crosstalk Compensation in Simple-Matrix LCDs," Japan Display '92, pp. 499-502.

P. Maltese, "Cross-Modulation and Nonuniformity Reduction in the Addressing of Matrix Displays," Proceedings of the SID, 26/2 1985, pp. 125-132.

Maltese, Paolo, "Cross-Modulation and Disuniformity Reduction in the Addressing of Passive Matrix Displays," Forth Display Research Conference, Sep. 18-20, 1984, Paris.

*Primary Examiner*—Richard A. Hjerpe
*Assistant Examiner*—Vivian W. Chang
*Attorney, Agent, or Firm*—Stoel Rives Boley Jones & Grey

[57] ABSTRACT

Image quality is improved in an rms-responding, passive matrix display system (10) by correcting for voltages induced onto row addressing electrodes (22) by voltage transitions on column electrodes (24). Net crosstalk voltages sensed at nodes (88N and 88P) between a row driver (72) and voltage sources (70N and 70P) correspond to the voltage induced on a row electrode plane (136). A correction voltage corresponding to the net crosstalk voltage on the row plane is applied to the voltage sources to correct the rms pixel voltages for the crosstalk.

24 Claims, 10 Drawing Sheets

246

52a
272
278
280
+Vrow
274N
101P
88P
TO ROW DRIVER 72a
270
276
102P
+10V
88N
101N
TO ROW DRIVER 72a
274P
102N
−Vrow
278
280
266
248
S3
264
262
268
S2
S1
260
262
+10V
270
264

PASSIVE MATRIX DISPLAY HAVING REDUCED IMAGE-DEGRADING CROSSTALK EFFECTS

TECHNICAL FIELD

The present invention relates to a method and system for addressing rms-responding displays and, in particular, to a method and system for reducing coupling crosstalk in high-information content, passive matrix liquid crystal displays.

Background of the Invention

Flat panel displays are used in a wide variety of applications including, for example, televisions, notebook computers, projection systems, and wireless communications devices, such as cellular phones. Images are formed on flat panel displays by electrically controlling the optical properties of a large number of individual picture elements, or "pixels," made of an electro-optical material, such as a liquid crystal material. The large number of pixels allows the formation of arbitrary information patterns in the form of text or graphic images. The optical state of each pixel, which depends upon the voltage present across it, is controlled by applying electrical signals to addressing electrodes. The number of electrodes necessary to address the large number of pixels is greatly reduced by having each electrode address multiple pixels. In one common embodiment, transparent electrodes are positioned on opposing inner surfaces of parallel, transparent plates. A matrix of pixels is typically formed by electrodes arranged in horizontal rows on one plate and vertical columns on the other plate to provide a pixel wherever a row and column electrode overlap. Addressing signals determined by the image to be displayed in accordance with an addressing system are placed onto the electrodes by addressing signal voltage drivers. Multiple periodic addressing signals are required to display a complete image.

A complete image is typically displayed in a time interval known as a "frame period." To form an image during the frame period, rows are typically "selected" during multiple "addressing intervals" that comprise the frame period. Image-dependent column signals determined in accordance with the addressing system are applied to the columns in each addressing interval. In an Alt and Pleshko-type system, each row is selected once during each frame period. In an Active Addressing TM-type addressing system, each row is selected multiple times during a frame period. In a full line Active Addressing TM-type addressing system, every row is selected in every addressing interval, and in a multiple line Active Addressing TM-type addressing system, more than one row, but less than all the rows, are selected in each addressing interval.

A typical liquid crystal display may have 480 rows and 640 columns that intersect to form a matrix of 307,200 pixels. It is expected that matrix liquid crystal displays may soon comprise several million pixels. As the number of matrix rows overlapping each column electrode increases, however, the contrast ratio, i.e, the difference in brightness between a light and dark pixel, decreases. One method of addressing large numbers of rows, the "dual scan method," entails dividing a display into two separately addressed sections, with each display section having an independent set of column and row electrodes. The column electrodes of each display section overlap only the row electrodes of the same display section. Display systems that do not use separately addressed sections are known as "single scan" displays.

Because more than one pixel is addressed by the same electrode and because of the proximity of the electrodes, the optical states of individual pixels can be incidentally affected by the optical states of other pixels in the display, an effect known as "crosstalk." The optical state of a pixel, i.e., whether it will appear dark, bright, or an intermediate gray shade, is determined by the root-mean-square ("rms") voltage difference during a frame period between the row and column electrodes at the pixel. The row and column electrodes form a parallel plate capacitor at each pixel, with the liquid crystal material in between as a dielectric. Voltage transitions on the column electrodes induce voltage transients, through capacitive coupling, onto the row electrodes and vice versa. This has the effect of altering the desired rms voltage across each pixel, thus altering its desired optical state. Because the column addressing signals are image dependent and each column electrode is capacitively coupled to every row electrode, the optical state of every pixel of a display can have an effect on the optical state of every other pixel. Applicants refer to the crosstalk phenomena caused by capacitive coupling as "coupling" crosstalk. The most striking manifestation of column to row coupling crosstalk is ghosting of images along the column axis of the display.

One method of reducing the effects of coupling crosstalk is described by Kaneko et al. in "Crosstalk-Free Driving Methods for STN-LCDs," *Proceedings of the SID*, Vol. 31/4, 333–336 (1990). Kaneko et al. describes a conventional Alt and Pleshko addressing system in which the number of column electrode voltage changes required at the start of an addressing interval is counted. A correction voltage based on the number of voltage changes is then applied to the electrodes of unselected rows. In addressing systems in which the column signals can have several possible voltage values, such as an Active Addressing TM-type addressing system, a simple count of the transitions, without considering their magnitudes, does not accurately characterize the induced voltages. The correction voltage, therefore, does not adequately reduce crosstalk in such an addressing system. Furthermore, because the correction factor is applied only to an unselected row, the method is less effective for addressing systems that select multiple rows during the same addressing interval because multiple rows will not receive the correction voltage.

Another method of mitigating the effects of coupling crosstalk, described by Hirai et al. in "A New Driving Method for Crosstalk Compensation in Simple-Matrix LCDs," Japan Display '92, 499–502, purportedly uses a separate undriven monitor row electrode to sense induced crosstalk voltages. The induced voltage sensed by the monitor electrode is used to generate a correction signal that is applied to the row electrodes. Because of the resistive and capacitive characteristics of the display electrodes, the voltage transients induced on the monitor electrode will depend upon its position in the display. Because the undriven monitor electrode does not form part of the image, however, placement of the monitor electrode is restricted to a position where the monitor electrode will not interfere with the image. Such placement prevents the monitor electrode from sensing induced voltages representative of the voltages induced on the driven electrodes where the images are actually formed on the display. The placement problem is more severe in applications that use a "dual scan" technique, i.e., a display divided into separate, independently addressed sections. Placing the reference electrode as the last row in the section would leave blank rows in the image. A driven monitor electrode that forms part of the image is not used to sense the induced voltage, because transitions in the drive voltage of the driven monitor electrode would result in voltage changes that would completely swamp out voltage transients induced by the coupling crosstalk.

SUMMARY OF THE INVENTION

An object of the present invention is, therefore, to improve image quality in an rms-responding, passive matrix display by reducing image-degrading crosstalk, i.e., incidental effects that the optical state of one pixel has on the optical states of other pixels in the display.

Another object of this invention is to correct image degradation caused by voltages induced on an electrode by voltage transitions of addressing signals applied to other electrodes.

A further object of this invention is to globally correct for voltages induced on the row electrodes by the image-dependent column signals without requiring separate circuitry to correct the signal applied to each electrode.

Yet another object of the present invention is to correct for changes in the rms pixel voltages caused by crosstalk in displays using either an Alt and Pleshkotype addressing systems or a full or multiple line Active Addressing TM -type addressing systems.

Still another object of the present invention is to correct for changes in the rms pixel voltages caused by crosstalk in displays using either a single or dual scan technique.

The present invention improves image quality in an rms-responding, passive matrix display by correcting the rms pixel values to compensate for voltages induced onto the addressing electrodes. Voltage transitions on the column electrodes result in induced transient voltages on the row electrodes, and vice versa. In Active Addressing TM -type addressing methods, the image-independent row signals switch only between two or among three voltage values. Row voltage transitions in opposite directions cause approximately equal and opposite induced transient voltages on the column electrodes, so the net effect of the row voltage transitions on the column electrodes is small.

The column addressing signals are, however, image dependent, and during an addressing interval the number of electrodes undergoing transitions to a higher voltage is usually different from the number of electrodes undergoing transitions to a lower voltage. Furthermore, in a system implemented in accordance with an Active Addressing TM -type addressing technique, the number of possible column signal voltage values is large so the magnitude as well as the number of transitions in each direction changes with the image. This results in a net coupling crosstalk voltage induced onto the row electrodes by the column electrode voltage transitions that changes the pixel voltages and, therefore, adversely affects image quality.

Within each independently addressed section of a display, each column electrode overlaps all of the row electrodes. Within each section, the row electrodes, therefore, can be considered as a single electrical plane for sensing and correcting crosstalk induced by voltage transitions on the column electrodes. In the present invention, voltage changes on the row plane are sensed in a part of the row electrode drive circuitry that is common to multiple row electrodes and, typically, removed from any individual electrode. Components of the voltage transients other than those caused by the column-to-row coupling crosstalk are eliminated to derive a coupling crosstalk transient voltage representative of the crosstalk on all of the row electrodes of that display section. A correction signal is then derived from the coupling crosstalk transient voltage and applied to the drive circuitry to correct all the row signals in that display section for the coupling crosstalk. In a dual scanning display, the coupling crosstalk in each independently addressed section of the display is separately sensed and corrected.

In a preferred embodiment, active crosstalk elimination ("ACE") circuitry senses during a first sub-interval of each addressing interval voltage transients in a part of the row drive circuitry common to all the row electrodes, thereby using the entire row plane to detect the crosstalk on the row plane. The voltage transients are summed to eliminate transient voltages caused by voltage transitions on the row electrodes, leaving a coupling crosstalk transient voltage corresponding to the voltage transients induced on the row plane by voltage transitions on the column electrodes. A single net coupling crosstalk potential corresponding to the coupling crosstalk is then determined, for example, by detecting and storing the peak value of the coupling crosstalk transient voltage or by integrating the coupling crosstalk transient voltage.

During a second subinterval of the addressing interval, a correction voltage related to the net coupling crosstalk potential is superimposed on the row electrodes to correct for the error in the rms pixel voltage caused by the crosstalk. The correction is performed by adjusting the voltage source of the row drivers by an amount opposite to the net coupling crosstalk potential. A correction signal is effectively applied to the row electrodes by superimposing it on the normal row addressing signals characteristic of the addressing method implemented.

The ACE circuitry is reset during a third subinterval of the addressing interval, thereby preparing the circuitry to sense the crosstalk voltage present during the next addressing interval and determine a new net coupling crosstalk potential. Additional objects and advantages of the present invention will be apparent from the following detailed description of preferred embodiments thereof, which proceeds with reference to the accompanying drawings.

DETAILED DESCRIPTION OF PREFERRED EMBODIMENTS

Figure 1:
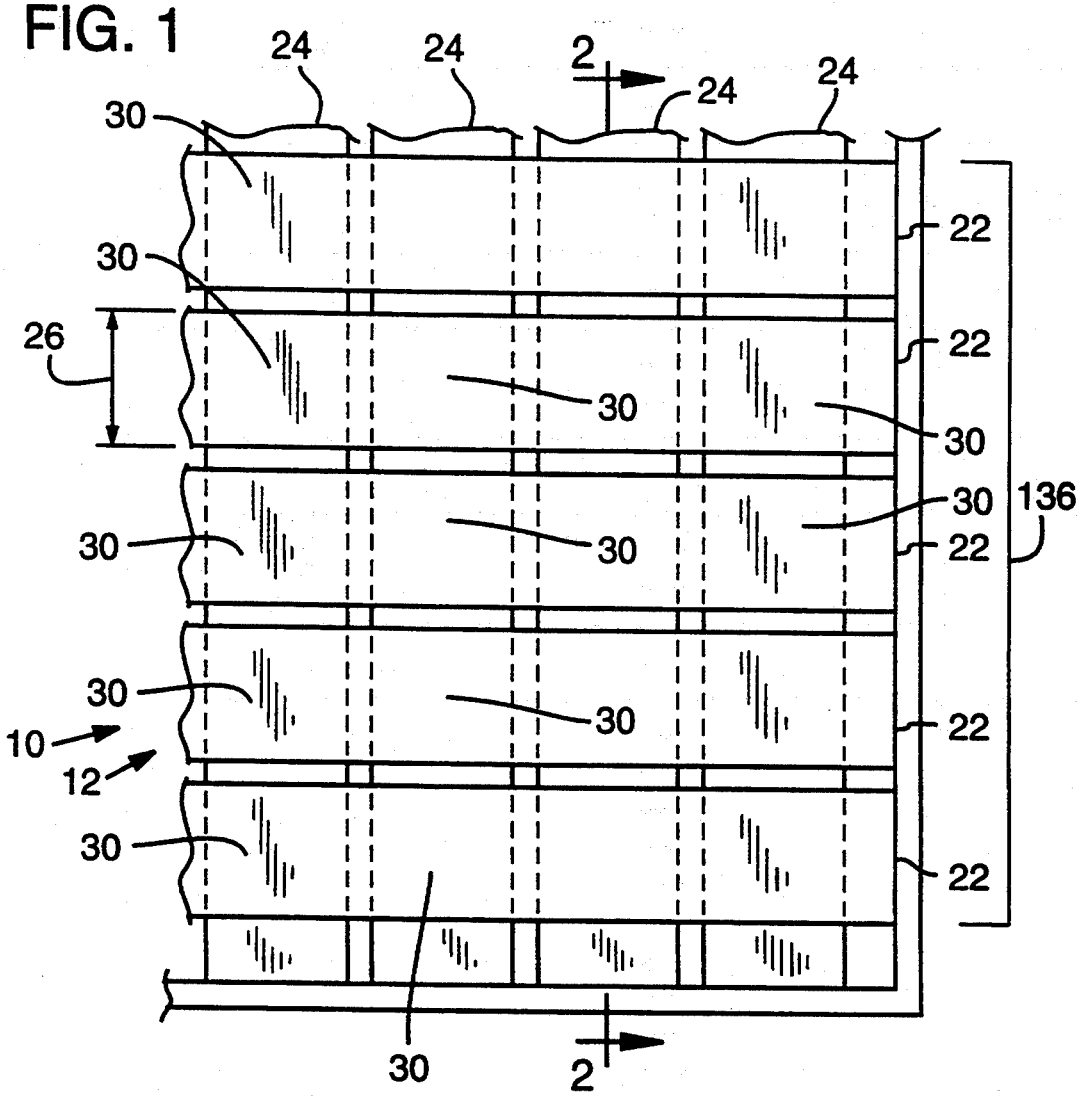
FIG. 1 is a diagrammatic, fragmentary plan view of a liquid crystal display of a type implemented with the present invention.
Figure 2:
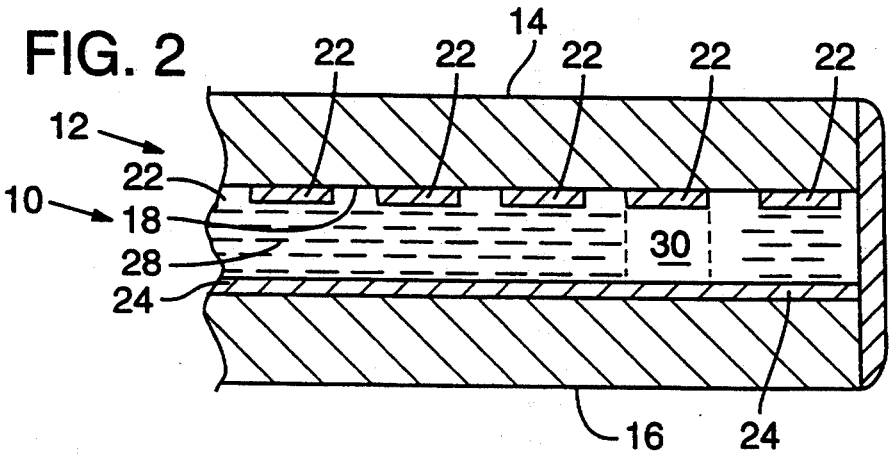
FIG. 2 is a sectional view taken along lines 2—2 of FIG. 1.

FIGS. 1 and 2 show part of a typical rms-responding display system 10 comprising a display panel 12 including two glass plates 14 and 16 having on their respective inner surfaces 18 and 20 respective first and second sets of electrodes 22 and 24. The first and second sets of electrodes 22 and 24 will be referred to as row electrodes 22 and column electrodes 24, although this designation is arbitrary and either set of electrodes could be arranged as rows or columns. Row electrodes 22 and column electrodes 24 are preferably oriented perpendicular to each other and are of equal width 26. An electro-optical material, such as a nematic liquid crystal 28 operated in a supertwist mode, is positioned between plates 14 and 16. The overlapping areas of row electrodes 22 and column electrodes 24 define a matrix of picture elements or pixels 30. Each row electrode 22 defines a row of pixels 30, and each column electrode 24 defines a column of pixels 30. Display system 10 includes a large number of such pixels 30, which together are capable of forming an arbitrary image.

The optical state of each pixel 30 is controlled by the voltage across it, the actual "pixel voltage," during each frame period. A pixel 30 is in an ON state when a sufficiently large voltage is applied. A pixel 30 is in an OFF state when a voltage below a threshold voltage, typically about one to two volts, is applied. A pixel 30 is in an intermediate gray state when it is neither fully ON nor fully OFF. Although an ON pixel 30 may be either bright or dark depending on the display design, it will be assumed below for convenience that a pixel 30 is bright in the ON state. If the characteristic response time of display 12 is many times longer than the frame period or if an Active Addressing TM addressing technique, as described in U.S. pat. application Ser. No. 07/678,736, filed Apr. 1, 1991 and assigned to the assignee of the present application, is used, the optical characteristics of pixel 30 during a frame period will depend primarily on the rms voltage value across the pixel.

The voltage across a pixel 30 is determined by the potential difference between the row electrode 22 and column electrode 24 at the overlapping area that defines the pixel 30. In a typical addressing system, image-independent voltage waveforms are applied to row electrodes 22 and image-dependent waveforms are applied to column electrodes 24. Because of the electrical characteristics of display panel 12, such as the capacitive coupling between and the finite resistance of electrodes 22 and 24, the actual rms voltage difference between electrodes 22 and 24 at pixel 30, i.e., the actual pixel voltage, deviates from the difference in potentials applied to electrodes 22 and 24 by their respective drivers.

Figure 3:
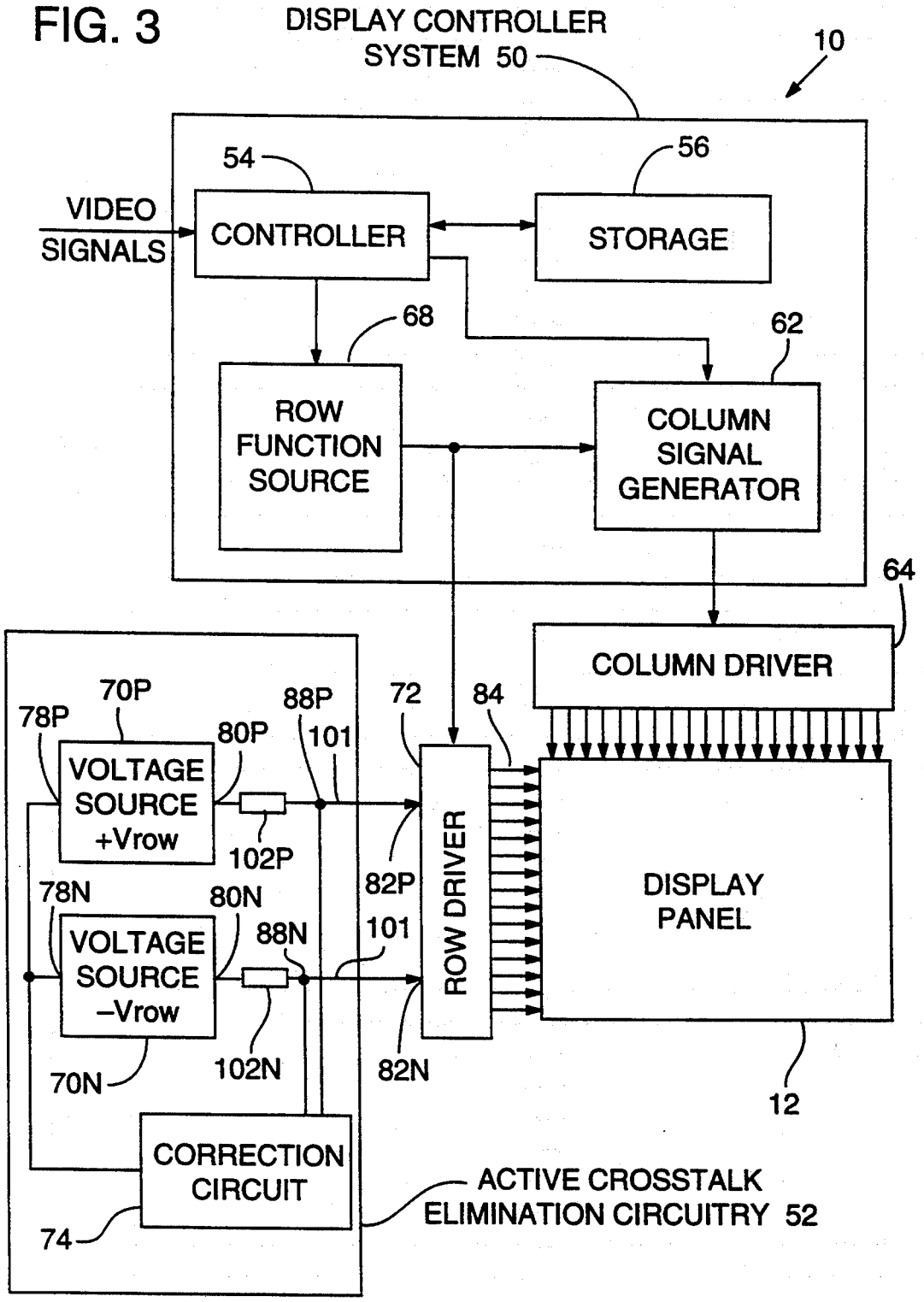
FIG. 3 is a block diagram of a preferred embodiment of a display incorporating the present invention.

FIG. 3 illustrates the components of a typical display system 10 incorporating the principles of the present invention. Display system 10 comprises a display controller system 50, active crosstalk elimination ("ACE") circuitry 52, and display panel 12 with associated column driver 64 and row driver 72. Display controller system 50 includes a controller 54 that receives video signals from an external source (not shown). The video signals include video display data and timing and control signals. The timing and control signals may include horizontal and vertical synchronization information. Upon receipt of the video signals, controller 54 formats the display data and transmits the formatted data to a storage device 56 for subsequent transmission to a column signal generator 62. Controller 54 provides timing and control signals to coordinate the operation of storage device 56, column signal generator 62, and a row function source 68.

Row function source 68 provides from either internal memory or internal function generation circuitry row functions in accordance with an addressing system. For example, in an Active Addressing TM -type addressing system, the row functions typically comprise an orthonormal set, such as bi-level Walsh or pseudo-random binary functions or tri-level functions such as those derived from the bi-level functions. In an Alt and Pleshko-type addressing system, the row functions consist of a single pulse for each image frame. Row function source 68 provides row signal information to row driver 72. Row driver 72 has inputs 82P and 82N and multiple outputs 84 that apply to row electrodes 22 (FIG. 1) voltages from voltage sources 70N or 70P in accordance with the row signal functions. Row function source 68 also provides row signal information to column signal generator 62 for use in combination with the image data to determine the column signals.

Column signal generator 62 determines image-dependent column signals in accordance with the addressing system and column driver 64 applies the column signals to column electrodes 24 of display panel 12. Although column driver 64 has multiple outputs, multiple column drivers 64 are typically required to provide addressing signals to all the column electrodes 24 (FIG. 1) of display 12. For example, a display having 640 columns would typically require four column drivers 64, each having 160 outputs.

ACE circuitry 52 functions as a voltage supply to row driver 72, supplying a voltage adjusted to correct the rms pixel voltage for the coupling crosstalk. ACE circuitry 52 comprises a correction circuit 74 and, in a preferred embodiment using a full line Active Addressing TM -type addressing system, voltage sources 70P and 70N. Voltage sources 70P and 70N have respective inputs 78P and 78N and outputs 80P and 80N, and provide at outputs 80P and 80N stable sources of binary voltage levels $+V_{row}$ and $-V_{row}$, respectively, for row driver 72. Row driver 72 provides to row electrodes 22 one of the binary voltage levels in a sequence corresponding to the row address function. ACE circuitry 52 and row driver 72, including output conductors 84, make up row drive circuitry. It will be understood that although a single row driver 72 is shown, display system 10 typically comprises several row drivers 72 to drive the all the row electrodes 22 of display panel 12. For example, a display having 480 rows may use six row drivers, each driving eighty row electrodes 22.

Figure 4:
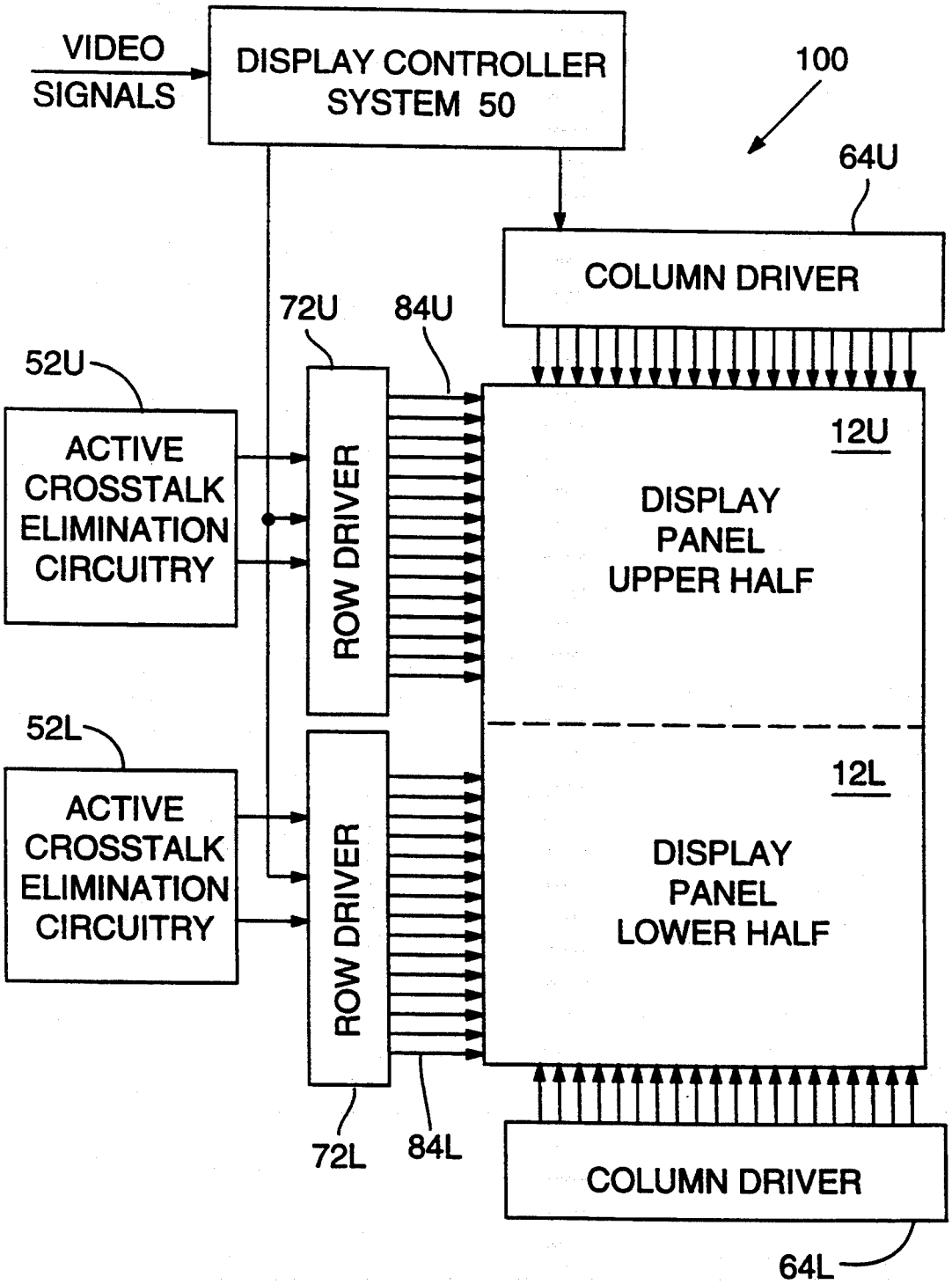
FIG. 4 is a block diagram of a preferred embodiment of a dual scan display incorporating the present invention.

FIG. 4 illustrates in general the components of a typical dual scan display 100 incorporating the principles of the present invention. Dual scan display 100 uses two separately addressed display panel sections: an upper half section 12U and a lower half section 12L. When implementing the present invention in a dual scan display, the coupling crosstalk of each of the two panels is independently sensed and corrected. In a typical dual scan embodiment, therefore, each panel section half uses an independent row driver 72U or 72L, an independent column driver 64U or 64L, and an independent ACE circuitry 52U or 52L. For example, dual scan display 100 has 480 total rows using two display panels section halves 12U and 12L, each panel section half having 240 row electrodes 22 driven by three row drivers 72U or 72L, each row drivers 72 having 80 output terminals 84. ACE circuitry 52U and 52L independently sense and correct the crosstalk in respective upper and lower section halves 12U and 12L.

Early in each addressing interval, while voltage levels on the row and column electrodes 22 and 24 are changing, transient currents appear on conductors 101 between voltage sources 70P and 70N and row driver 72 (FIG. 3). As the transient currents are conducted through a resistors 102N and 102P, correction circuit 74 detects transient voltages at nodes 88P and 88N. Correction circuit 74 determines from the transient voltages a correction signal and applies it to voltage sources 70P and 70N to correct the rms pixel voltages for the crosstalk.

Within each display panel 12 or display panel half 12U and 12L, each column electrode 24 overlaps every row electrode 22. The row electrodes within each display panel 12 of a single scan display or display panel half 12U and 12L of a dual scan display can, therefore, be considered, for purposes of column-to-row capacitive coupling, as a single conductive row plane 136 (FIG. 1). By sensing the transient voltages at nodes 88P and 88N, the entire row plane 136 is used as a global "monitor electrode" to determine the crosstalk. Furthermore, the crosstalk can be corrected by applying a single correction voltage to all row electrodes 22 within each display panel 12 or display panel section half 12U or 12L. The crosstalk is typically corrected by adjusting row voltage sources 70P and 70N using a signal corresponding to the net coupling crosstalk potential, thereby correcting all rows 22 for the coupling crosstalk.

Figure 5A:
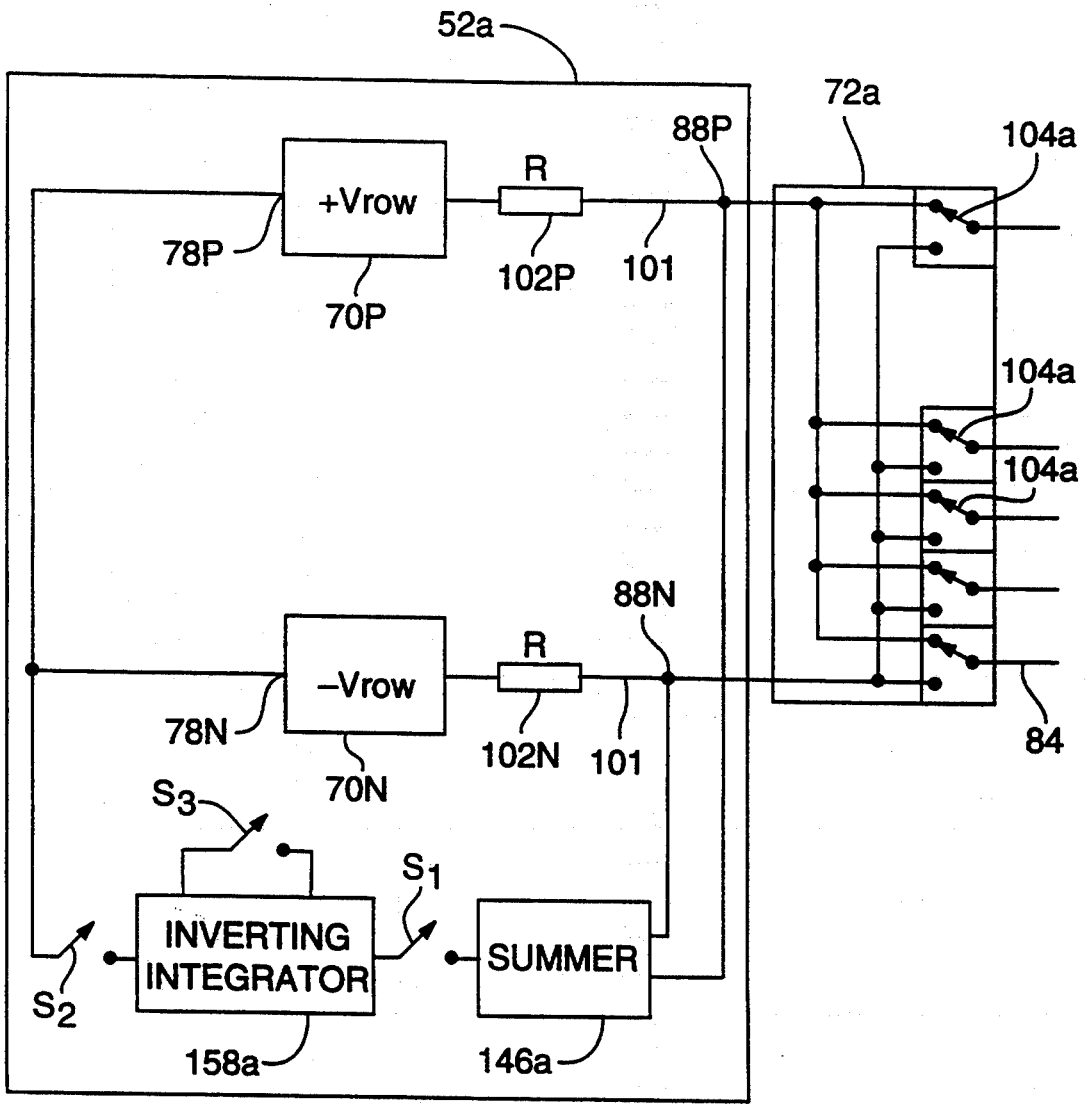
FIG. 5*a*, 5*b*, and 5*c* are block diagrams showing in general the system components of preferred correction circuits of the present invention implemented in displays using full line Active Addressing TM -type addressing technique, multiple line Active Addressing TM addressing technique, and Alt and Pleshko addressing technique, respectively.

FIG. 5*a* is a block diagram showing in greater detail a row driver 72*a* and an ACE circuitry 52*a* as implemented in a full line Active Addressing TM -type addressing system. FIG. 5*a* shows that transient voltages are sensed at node 88P between row driver 72*a* and voltage source 70P, and at node 88N between row driver 72*a* and voltage source 70N. The voltages sensed at nodes 88N and 88P correspond to transients in the power supply current, converted to a corresponding transient voltage across resistors 102N and 102P. ACE circuit 52*a* uses the current transients and their corresponding voltages to derive a single value representative of the induced crosstalk voltage on row plane 136 during each addressing interval, thereby providing an opportunity to correct the rms pixel values of the entire display for the crosstalk.

Row driver 72*a* applies to row electrodes 22, depending upon the state of SPDT switches 104*a*, either a positive row voltage $+V_{row}$ from voltage source 70P or a negative row voltage $-V_{row}$ from voltage source 70N. Because voltages $+V_{row}$ and $-V_{row}$ are equal and opposite, the sum of the sensed voltages, as determined by summer 146, should ideally be zero. However, the sensed voltages vary from the ideal because of crosstalk.

In a typical full line Active Addressing TM -type addressing system, the number of rows undergoing transitions from $+V_{row}$ to $-V_{row}$ is approximately equal to the number of rows undergoing transitions from $-V_{row}$ to $+V_{row}$. Because the voltage transients induced by these opposite voltage transitions are of nearly equal magnitude but opposite sign, the voltage transients at nodes 88P and 88N caused by row voltage transitions cancel each other in summer 146*a*.

Voltage transitions on column electrodes 24 cause, however, induced voltages of the same polarity on all row electrodes 22, resulting in a coupling crosstalk transient voltage that remains after the summation and corresponds only to the coupling crosstalk. By eliminating in summer 146*a* voltage transients corresponding to switching voltage levels on row electrodes 22, an inverting integrator 158*a* can determine a single net coupling crosstalk potential that corresponds primarily to the coupling crosstalk, thereby allowing the coupling crosstalk to be determined and effectively eliminated. Summer 146 thus allows multiple row electrodes 22 to which addressing signals are applied to also be used for sensing the crosstalk.

Figure 5B:
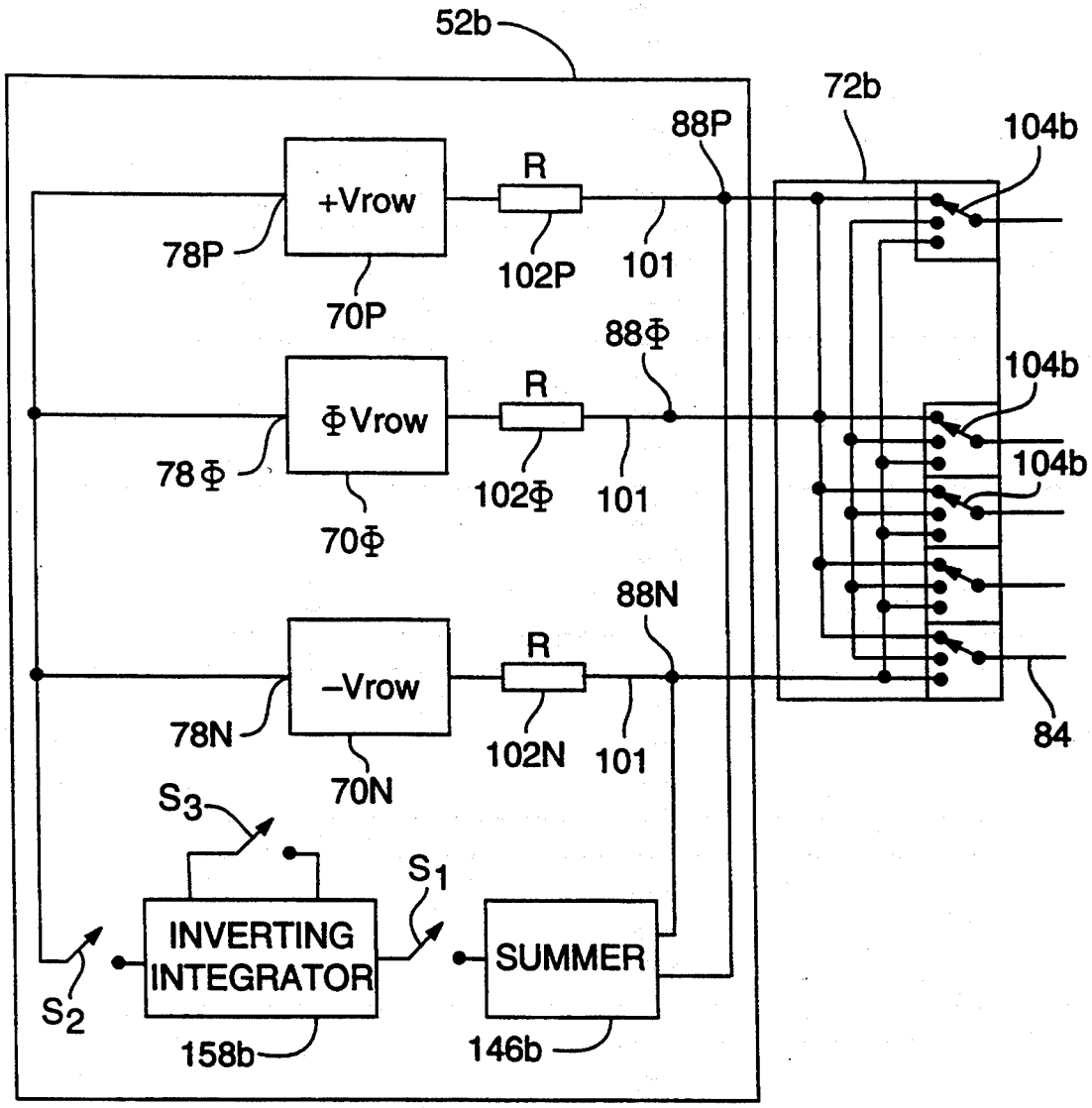

FIG. 5*b* shows a block diagram, similar to that shown in FIG. 5*a*, of a row driver 72*b* and ACE circuitry 52*b* as implemented in a multiple line Active Addressing TM type-addressing system. A multiple line Active Addressing TM -type addressing system typically uses tri-level row signals and requires, therefore, positive, reference, and negative voltage sources 70P, 70Φ, and 70N, respectively. The reference voltage is typically zero volts. In accordance with an addressing system, row driver 72*b* applies to each row electrode 22 one of the three available voltages, depending on the state of SP3T switches 104*b*. Voltages sensed at nodes 88P, 88Φ, and 88N are summed in summer 146*b* and integrated in inverting integrator 158*b* to determine a correction signal for application to voltage sources 70P, 70Φ, and 70N. Because of the nature of the row functions, transient voltages associated with the row electrodes switching between these three voltage levels are effectively cancelled in summer 146*b*.

Figure 5C:
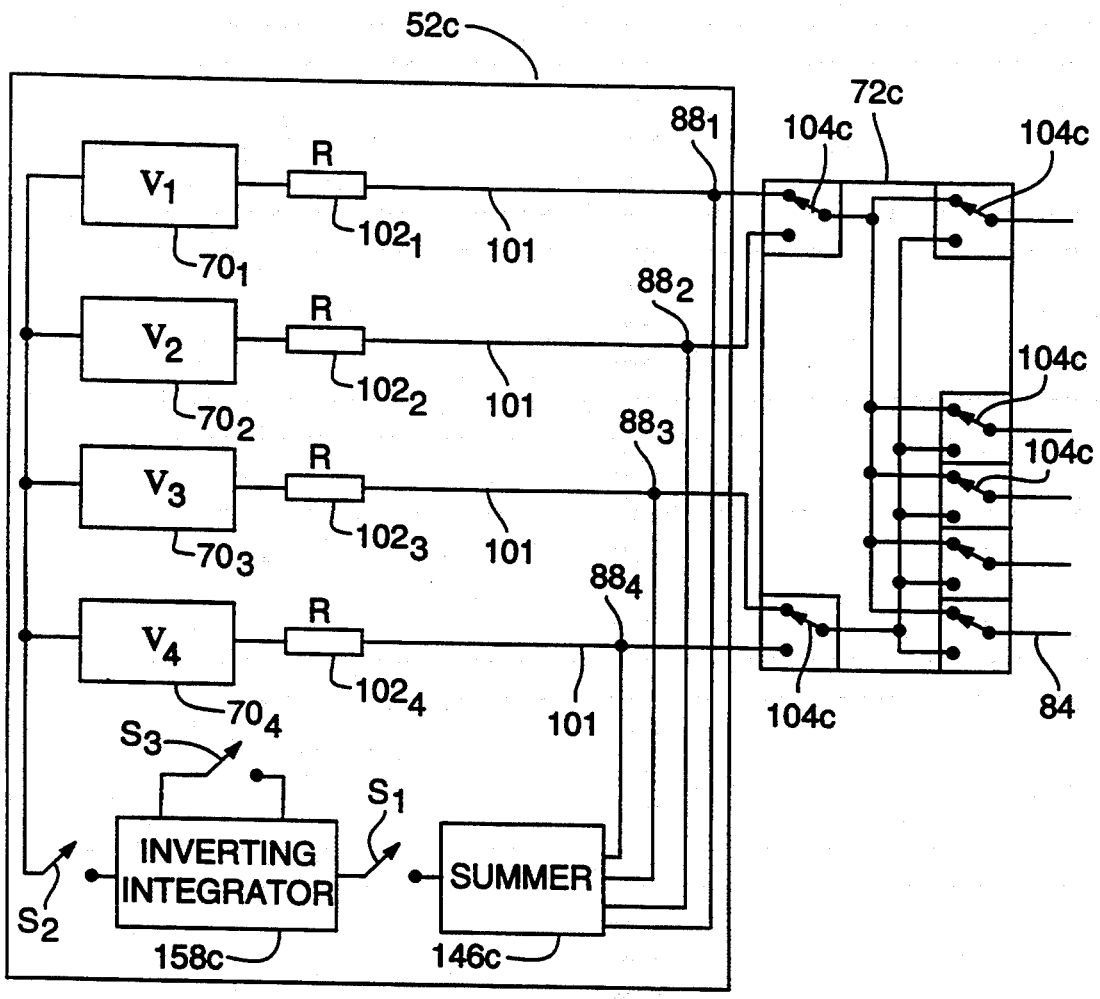

FIG. 5*c* shows a block diagram, similar to those shown in FIGS. 5*a* and 5*b*, but showing a row driver 72*c* and ACE circuitry 52*c* as implemented in an Alt and Pleshko-type addressing system. An Alt and Pleshko-type addressing system typically inverts and offsets both row and column signals at regular intervals to decrease the overall voltage requirements on the row driver and to prevent potentially damaging net DC voltages from appearing across the liquid crystal material. This implementation requires four voltage sources, $70_1$, $70_2$, $70_3$, and $70_4$, and SPDT switches 104*c* in a row driver 72*c* switch between four possible states in accordance with the addressing system to apply one of four possible voltages to each of row electrodes 22. Voltages sensed at nodes $88_1$, $88_2$, $88_3$, and $88_4$ are summed in summer 146*c* and integrated in inverting integrator 158 to determine a correction signal for application to voltage sources $70_1$, $70_2$, $70_3$, and $70_4$.

Figure 6:
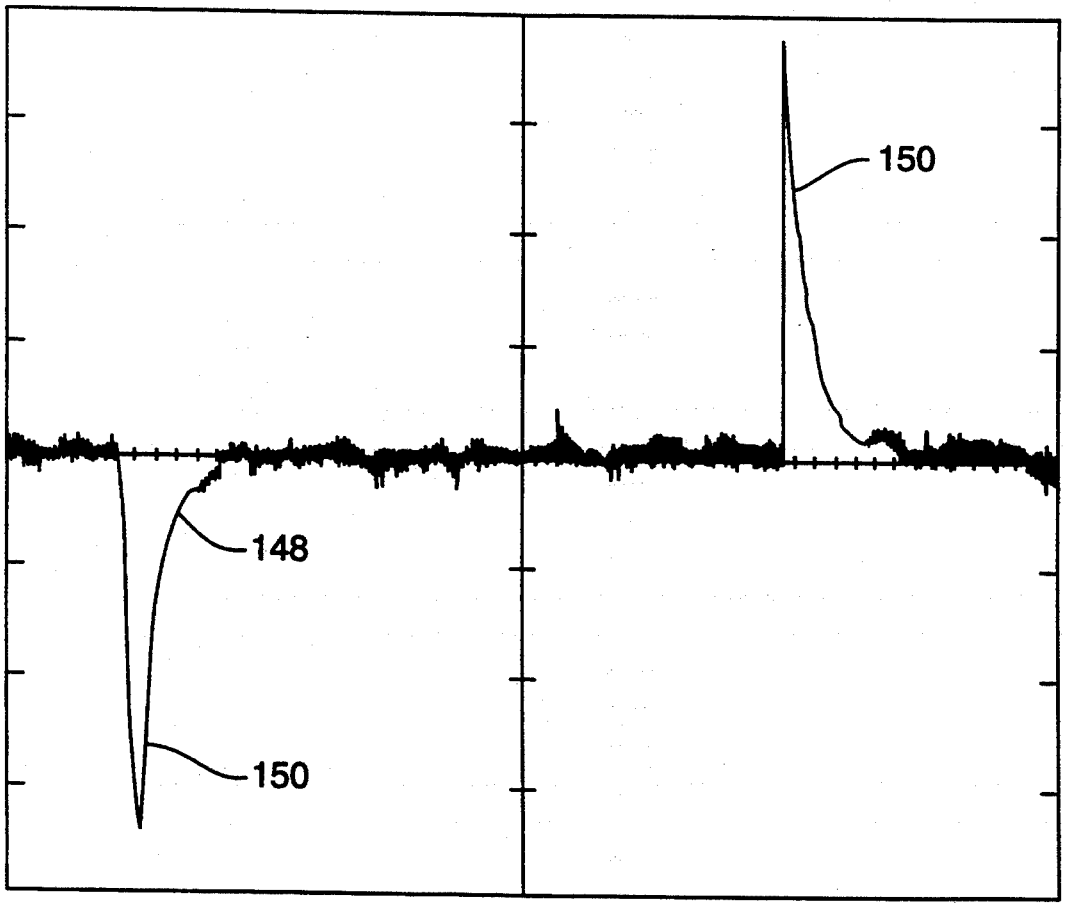
FIG. 6 is an oscilloscope trace of a signal appearing on the row driver input conductors and representing the sum of the induced voltages caused by voltage transitions on the column electrodes.

FIG. 6 is an oscilloscope trace of the output of summer 146 showing a signal 148 having voltage spikes 150 that represent the crosstalk voltages induced onto row electrodes 22. It will be understood that the voltages of voltage source 70P and 70N are typically biased so that one is not the true inverse of the other. Furthermore, a non-zero reference voltage may be used in a display using a multiple line Active Addressing TM type-addressing system. Such a bias and non-zero reference voltage are easily accounted for in ACE circuitry 52.

Inverting integrator 158*a* (FIG. 5*a*) integrates, inverts, and stores the summed potential corresponding to the coupling crosstalk voltage transitions caused by transitions on column electrodes 24 inducing voltages on row electrodes 22. When the voltage transitions on column electrodes 24 are essentially complete, a switch S1 is opened to electrically disconnect inverting integrator 158 from nodes 88P and 88N and leave at the output of inverting integrator 158 a voltage representing a net coupling crosstalk potential. A second switch S2 is closed to apply to the voltage sources 70P and 70N a correction voltage corresponding to the inverted net coupling crosstalk potential provided by inverting integrator 158*a*. The correction voltage applied to voltage sources 70P and 70N causes them to apply corrected drive signals to row driver 72*a* to correct the rms pixel voltage for the coupling crosstalk. The time period during which the corrected drive voltage is applied defines a second subinterval of addressing interval $\Delta t_k$. After the correction voltage is applied, a third switch S3 is closed to reset inverting integrator 158 in preparation for integrating the crosstalk potential during the next addressing interval $\Delta t_k$.

Figure 7:
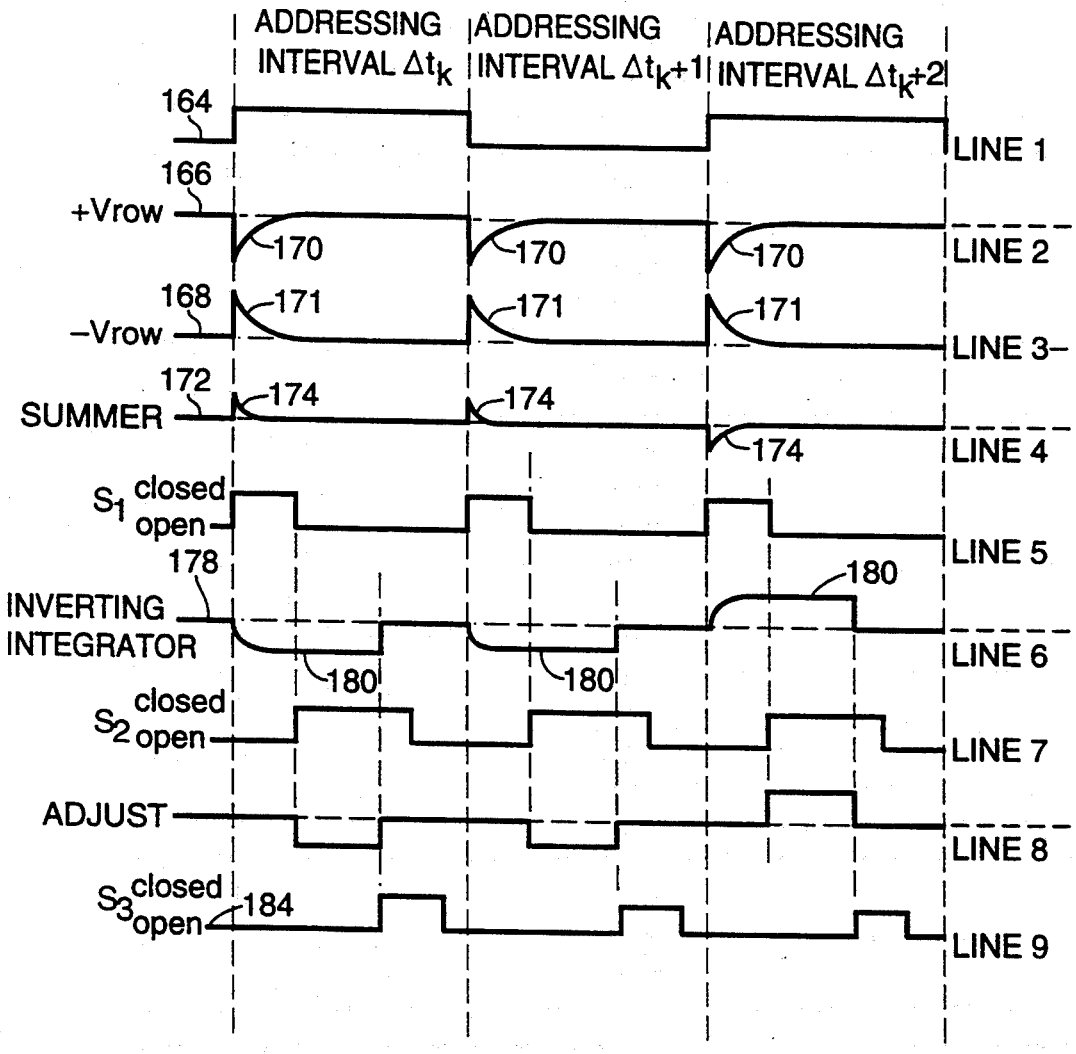
FIG. 7 is a timing diagram showing the sequence of signal transitions occurring during an addressing interval.

FIG. 7 is a timing diagram showing the sequence of events that take place to correct for crosstalk voltages induced on row electrodes 22. Line 1 indicates the durations of sequential addressing intervals $\Delta t_k$, $\Delta t_{k+1}$, and $\Delta t_{k+2}$. Lines 2 and 3 show typical voltages 166 and 168 detected at the respective sensing nodes 88P and 88N. Voltages 166 and 168 include respective voltage transients 170 and 171. Line 4 shows the result of summing voltages 166 and 168. The components of voltages 166 and 168 resulting from voltage level transitions on row electrodes 22 cancel by the operation of summer 146. Voltage transients induced on voltages 166 and 168 by voltage transitions on column electrodes 24 do not cancel, leaving a coupling crosstalk transient voltage 172, having voltage spikes 174 of arbitrary polarity smaller than voltage spikes 170 and 171.

With reference to FIGS. 5*a–c* and 7, line 5 represents the position of switch S1, which is closed at the beginning of each addressing interval. Switch S1 remains closed while voltage transitions take place on column electrodes 24, inducing crosstalk voltages onto the row electrode plane. When closed, S1 passes the signal appearing at the output of summer 146 for integration by inverting integrator 158, whose output voltage 178 shown in line 6 after S1 is opened includes a level portion 180 that corresponds to the inverted net coupling crosstalk potential for each of addressing intervals $\Delta t_k$, $\Delta t_{k+1}$, and $\Delta t_{k+2}$.

The summation and integration processes occur during a first subinterval of each addressing interval. The end of the first subinterval is triggered when the column voltage transitions are substantially complete by a clock signal at a predetermined time measured from the beginning of the addressing interval. At the end of the first subinterval, switch S1 opens and switch S2, whose switching state is indicated by line 7 closes to apply the inverted net coupling crosstalk potential at the output of inverting integrator 158 to voltage sources 70P and 70N. The integrator output voltage is applied as shown in line 8 during a second subinterval of a predetermined duration as a correction voltage to adjust the drive voltage by an amount that produces an effect on the rms voltage approximately equal and opposite to that of the crosstalk.

After the correction voltage has been applied to voltage sources 70P and 70N during the second subinterval, switch S3, having a state represented by line 9, is closed to reset inverting integrator 158. After S3 has been closed for a brief period of time, switch S2 is re-opened and then S3 is re-opened to prepare for the next addressing interval $\Delta t_{k+1}$. During the part of each addressing interval $\Delta t_k$ when voltage transitions are taking place on the column electrodes, the coupling crosstalk transient voltage is integrated, inverted, and stored to determine an inverted net coupling crosstalk potential. After the column voltages have stabilized, the inverted net coupling crosstalk potential is applied as a correction signal to row signal voltage sources 70P and 70N, thereby adjusting the applied voltage to correct for the coupling crosstalk.

The absolute amplitude and duration of the correction signals are empirically determined by fixing one and adjusting the other to minimize observable crosstalk effects on display system 10. While observing ghosting above or below a test image on display system 10, the correction signal is adjusted until the ghosting disappears. Once the gain and duration of the correction signal are adjusted for a test image, correction signals for other images produced by correction circuit 74 will have the correct values. The duration of the correction signal is controlled by electronic switches S2 and S3. The correction signal is applied when S2 is closed and the correction signal is removed when S3 is closed. The opening and closing of S2 and S3 are controlled by conventional timing circuits. Adjusting the gain of the correction signal rather than its duration is preferred because a correction signal having a short duration will include high frequency components that are less effective in correcting the image.

Observable crosstalk effects are minimized when the correction signal, applied for the duration of the second subinterval, produces an effect on the rms pixel voltage equal and opposite to that of the crosstalk. A net coupling crosstalk potential related to the net crosstalk voltage can be determined by methods other than integration. For example, a net coupling crosstalk potential can be determined by known circuitry that detects the peak of the net crosstalk voltage. A net coupling crosstalk potential related to the peak voltage can be applied as the correction signal.

Figure 8:
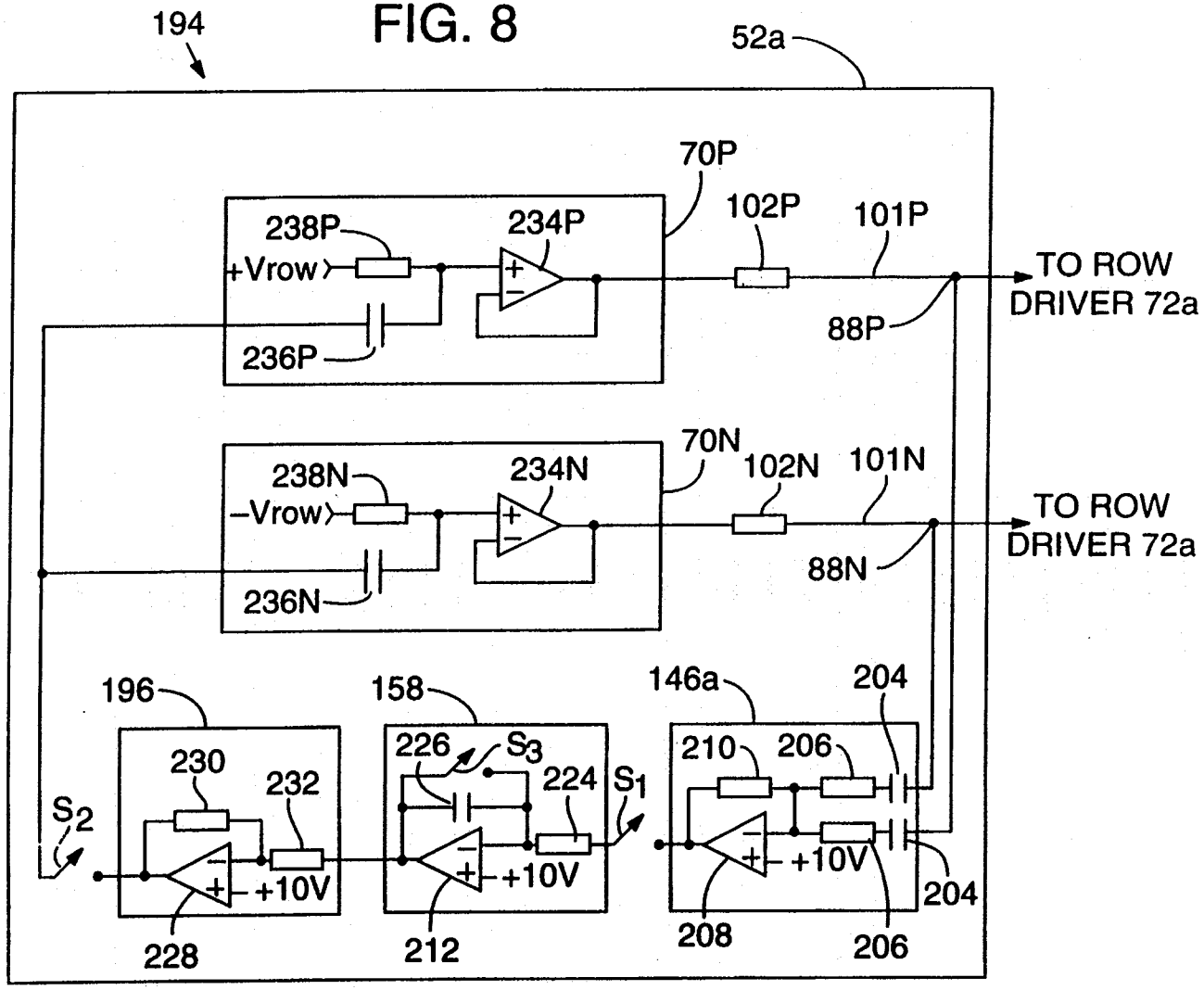
FIG. 8 is a schematic diagram of a correction circuit used to implement the present invention.

FIG. 8 is a schematic diagram of showing a preferred circuit 194 used to implement ACE circuitry 52*a* in a display system 10 using a full line Active Addressing TM type-addressing system. The major components of circuit 194 comprise summer 146*a*, inverting integrator 158, a unity gain inverting amplifier 196, and voltage sources 70P and 70N.

Summer 146*a* includes two series-connected capacitor 204 and resistor 206 input branches, each of capacitors 204 being connected to a different input node 88N and 88P and resistors 206 being connected to the inverting input of an operational amplifier 208. A feedback resistor 210 provides a unity gain negative feedback amplifier for the sum of the signals applied to the input branches. Resistors 206 and 210 are 1.8 kΩ, and capacitors 204 are 4.7 μF AC coupling capacitors. A +10 V bias applied to the noninverting input of amplifier 208 provides an offset so that circuit 194 can be realized without the use of a negative voltage power supply. An electronic switch S1, such as a DG405 field-effect transistor switch, provides an interruptible electrical connection between summer 146a and inverting integrator 158.

Inverting integrator 158 comprises an operational amplifier 212 having its inverting input connected to switch S1 through a 10 kΩ resistor 224. A parallel-connected 0.01 μF capacitor 226 and switch S3 positioned between the output and inverting input of amplifier 212 form an inverting integrator 158 that is resettable by closing S3 near the end of an addressing interval preparatory to sensing crosstalk voltages during the subsequent addressing interval. The values of resistor 224 and capacitor 226 set the integration time constant for inverting integrator 158. The output of inverting integrator 158 represents the net coupling crosstalk potential. The output of integrator 158 is inverted by an inverting amplifier 196, which includes an operational amplifier 228 and feedback and input 1.8 KΩ resistors 230 and 232, respectively. The values of resistors 230 and 232 can be altered to change the gain of the correction signal to an appropriate level to eliminate the crosstalk. The output signal of amplifier 196 represents the correction signal applied to voltage sources 70P and 70N during the second subinterval of the addressing interval. The noninverting inputs of operational amplifiers 212 and 228 receive a +10 V bias for the same reason as that described for amplifier 208.

Amplifier 196 inverts the net coupling crosstalk potential that appears at the output of integrator 158 so that the correction signal is of opposite sign to and can compensate for the crosstalk. Switch S2, positioned at the output of inverting amplifier 196, closes during the second addressing subinterval to apply the correction signal from amplifier 196 to voltage sources 70P and 70N. The operation of switches S1 and S3 is coordinated so that both switches are never closed at the same time, thereby preventing the creation of a conductive path through summer 146a, inverting integrator 158, and amplifier 196 that would short-circuit the input and output of voltage sources 70P and 70N.

Voltage sources 70P and 70N include respective operational amplifiers 234P and 234N, the noninverting input of each receiving through a 4.7 μF capacitor 236 the capacitively coupled correction signal conducted through switch S2 to offset a positive reference voltage source $+V_{row}$ and a negative reference voltage source $-V_{row}$ which are applied through 10 kΩ resistors 238 to the noninverting input. The outputs of operational amplifiers 234P and 234N are connected through 10Ω resistors 102N and 102P to row driver 72a to provide a corrected drive signal that corrects the pixel voltages for the crosstalk and to summer 146a through nodes 88P and 88N for sensing current transients induced on conductors 101P and 101N. Resistors 238, capacitors 236, and amplifiers 234 function as a buffer amplifier having a time constant of approximately 47 ms. The time constant is long relative to the duration of the second subinterval, so the correction voltage is relatively constant during the second subinterval.

Figure 9:
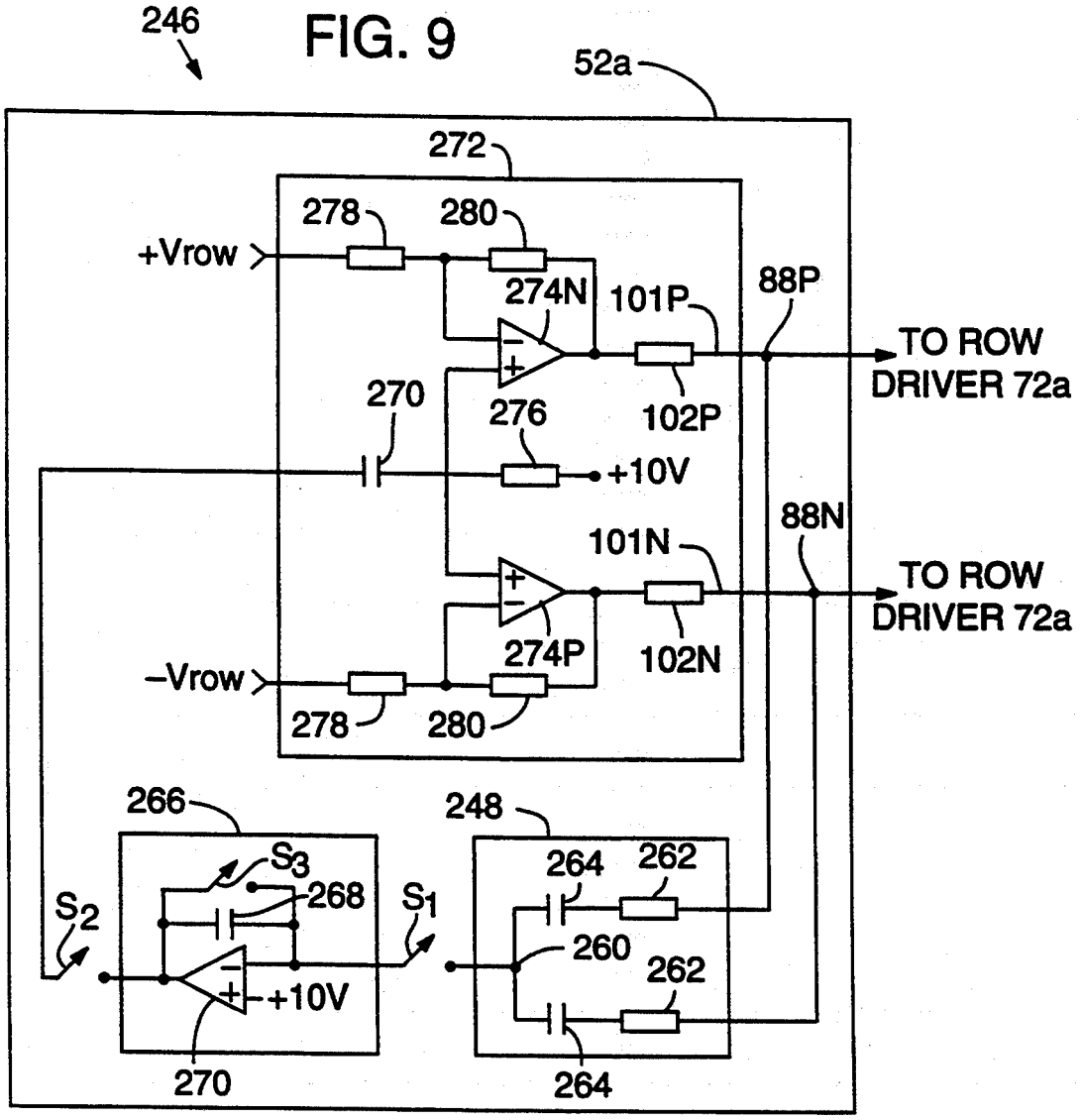
FIG. 9 is a schematic diagram of an alternative correction circuit used to implement the present invention.

FIG. 9 is a diagram of an alternative, simplified circuit 246 to circuit 194 of FIG. 8. Circuit 246 uses two fewer inverting amplifiers than the number of amplifiers used in circuit 194.

A summer 248 is similar to summer 146a of FIG. 8 except that the unity gain inverting amplifier 208 of the latter is omitted. The two input branches are connected to a summing node 260, to which switch S1 is connected. Resistors 262 are 3.3 kΩ, and capacitors 264 are 1.0 μF AC coupling capacitors.

An integrator 266 is similar to integrator 158 of FIG. 8 except that resistor 224 is omitted and inverting amplifier 196 is omitted. Switches S1 and S2 are, therefore, positioned at the input and output, respectively, of integrator 266. The value of capacitor 268 is 0.01 μF, and the gain required to accomplish input signal integration is provided by amplifier 270, as is true for amplifier 212 of FIG. 8.

A net coupling crosstalk potential appearing at the output of integrator 266 is AC coupled by a 1.0 μF capacitor 270 to a modified output buffer amplifier circuit 272, which when combined with voltage reference sources $+V_{row}$ and $-V_{row}$ is analogous to voltage sources 70N and 70P in FIG. 8. The operation of buffer circuit 272 differs from the operation of the buffer amplifiers in voltage sources 70N and 70P of FIG. 8 in two principal ways. Circuit 272 provides a gain of two to the corrected drive signals delivered to the row drivers and uses the differential inputs of operational amplifiers 274P and 274N to sum the correction signal with the respective positive and negative reference voltage sources $+V_{row}$ and $-V_{row}$. The AC coupled compensating signal together with the +10 volt bias delivered through a 3.3 kΩ resistor 276 is applied to the noninverting inputs of amplifiers 274P and 274N, whose respective inverting inputs receive positive reference voltage $+V_{row}$ and negative reference voltage $+V_{row}$ through a 3.3 kΩ resistor 278. A 3.3 kΩ feedback resistor 280 together with resistor 278 set at two the closed loop amplifier gain. The value of feed resistor 280 can be altered to change the gain of the correction signal to an appropriate level to eliminate the crosstalk. The corrected row drive signals appear at the outputs of amplifiers 274P and 274N and are delivered through 10Ω resistors 102P and 102N to row driver 72a and through nodes 88N and 88P for sensing current transients in conductors 101N and 101P.

Although the preferred embodiment senses the crosstalk and applies the correction signal during separate sub-intervals of the addressing interval, the invention could also be implemented in other ways, such as by simultaneously sensing and correcting for the crosstalk. For example, rather than determining a net coupling crosstalk potential as in the preferred embodiment, the coupling crosstalk transient voltage can be inverted and applied to row electrodes 22.

ACE circuitry 52 can determine the correction signal by sensing the coupling crosstalk using less than the entire row plane 136. For example, ACE circuitry can sense transient voltages from a single row driver 72 of a display system 12 using multiple row drivers, or from multiple row electrodes 22. An independent correction signal could be delivered to different sets of row electrodes 22, for example, to each set of row electrodes 22 driven by a common row driver 72.

It will be obvious that many changes may be made to the above-described details of the invention without departing from the underlying principles thereof. The methods are equally applicable to displays with and without intermediate gray levels. Although the embodiments described use the full line Active Addressing TM-type addressing technique, which selects every row during every addressing interval, the invention is applicable to many other addressing methods or systems, including Alt and Pleshko-type addressing techniques, which select each row once per frame, and multiple line Active Addressing TM-type addressing systems that select more than one, but fewer than all the display rows during an addressing interval. The scope of the present invention should, therefore, be determined only by the following claims.

We claim:

1. An addressable rms-responding passive display, comprising:

first electrode drive circuitry including a first electrode driver and multiple first electrode voltage sources that supply output voltages to the first electrode driver;

first and second overlapping electrodes receiving respective first and second addressing signals, the first electrode driver providing the first addressing signals to the first electrodes;

an array of pixels defined by overlapping areas of the first and second electrodes, each pixel having an optical state controlled by a pixel voltage determined by the first and second addressing signals; and a correction circuit for detecting at nodes in the first electrode drive circuitry associated with multiple output voltages, transient voltages in multiple first electrodes by voltage transitions in the second electrodes, summing the transient voltages to determine a coupling crosstalk transient voltage, and applying a correction signal derived from the coupling crosstalk transient voltage to correct the rms pixel voltage for the crosstalk voltage.

2. The display of claim 1 in which the nodes are located between the voltage sources and the electrode driver.

3. The display of claim 1 in which the correction circuit further comprises an integrator circuit for determining the correction signal.

4. The display of claim 3 in which the summer circuit has inputs electrically connected to nodes between the voltage sources and the electrode driver, and in which the correction circuit has an output that is connected to the voltage sources.

5. The display of claim 1 in which the correction circuit includes a peak detector.

6. A method of improving image quality in an rms-responding passive display that includes an array of pixels defined by overlapping areas of first and second electrodes, the first electrodes conducting image-independent first addressing signals provided by first electrode drive circuitry including a first electrode driver and multiple first electrode voltage sources providing multiple output voltages, and the second electrodes conducting image-dependent second addressing signals, the optical state of each pixel being determined by a pixel voltage determined by the potential difference at the pixel between the first and second electrodes defining the pixel, the electrodes having incidental capacitive couplings such that voltage transitions on the second electrodes induce onto multiple first electrode voltages affecting the pixel voltages of pixels in the array, the method comprising:

applying first and second addressing signals to the respective first and second electrodes;

sensing transient voltages on first electrodes at multiple nodes associated with multiple drive voltages;

summing the sensed voltages to determine a crosstalk voltage corresponding to the voltages induced by voltage level transitions on the second electrodes onto the first electrodes; and applying a correction voltage derived from the crosstalk voltage to multiple first electrodes.

7. The method of claim 6 in which sensing the induced voltage further comprises storing information corresponding to the derived voltage and in which applying a correction voltage includes determining a correction signal voltage from the stored information.

8. The method of claim 6 in which sensing a voltage includes accumulating a single potential corresponding to the voltage induced on all the first electrodes by voltage transitions on the second electrodes and in which applying a correction signal includes applying a correction signal corresponding to the inverse of the single potential.

9. The method of claim 6 in which summing multiple voltages including eliminating voltage components corresponding to row voltage transitions to determine a voltage corresponding to induced voltages from column voltage transitions.

10. The method of claim 6 in which the display includes multiple display sections, each having independently overlapping first and second electrode, and in which the multiple nodes are associated with and the correction voltage is applied to the same display section.

11. The method of claim 6 in which induced voltages on electrodes to which addressing signals are applied are sensed.

12. The method of claim 6 in which the correction voltage is applied simultaneously with the sensing of the induced voltages.

13. The method of claim 6 in which the voltage is sensed at nodes between the first electrode voltage sources and the first electrode driver.

14. The method of claim 6 in which sensing voltages induced on first electrodes includes determining during a first subinterval of an addressing interval voltages induced on the first electrodes by voltage level transitions on the second electrodes and applying a correction voltage includes adjusting during a second subinterval of the addressing interval voltages applied to the first electrodes to correct the rms pixel voltage for the induced voltages determined during the first subinterval.

15. The method of claim 14 in which summing the voltages further includes integrating the induced voltage during the first subinterval to derive the correction voltage.

16. The method of claim 14 in which the first electrode driver has multiple inputs and outputs, the outputs applying the first addressing signals to the first electrodes, and the multiple nodes are located at the inputs of the first electrode driver.

17. The method of claim 16 in which adjusting the voltage includes adjusting the voltage applied to the first electrode driver input.

18. The method of claims 14 in which applying first addressing signals includes selecting a single first electrode during each addressing interval.

19. The method of claim 14 in which applying first addressing signals includes selecting multiple first electrodes during each addressing interval.

20. The method of claim 19 in which applying first addressing signals includes applying first addressing signals having waveforms that belong to a set of orthonormal functions, the first addressing signals selecting the first electrodes multiple times during each addressing interval.

21. The method of claim 20 in which each first electrode is addressed by a different one of the set of orthonormal functions.

22. The method of claim 19 in which applying first addressing signals includes selecting fewer than all rows during each addressing interval.

23. The method of claim 6 in which the multiple drive voltages include selection voltages.

24. The method of claim 6 in which the multiple drive voltages include selection and non-selection voltages.

* * * * *